US005361847A

United States Patent [19]

Phelps

[11] Patent Number: 5,361,847

[45] Date of Patent: Nov. 8, 1994

[54] FAILSAFE PHIAL-TYPE FIRE EXTINGUISHING SYSTEM

[75] Inventor: Graham B. Phelps, Colchester, United Kingdom

[73] Assignee: Pyroguard Limited, London, England

[21] Appl. No.: 37,715

[22] Filed: Mar. 24, 1993

Related U.S. Application Data

[63] Continuation of Ser. No. 619,885, Nov. 29, 1990, abandoned.

[30] Foreign Application Priority Data

Feb. 20, 1990 [GB] United Kingdom ..... 9003774.8

[51] Int. Cl.[5] ..... A62C 37/40

[52] U.S. Cl. ..... 169/58; 169/26; 169/51; 169/61

[58] Field of Search ..... 169/26, 28, 38, 51, 169/54, 57, 58, 61; 232/17, 19, 21

[56] References Cited

U.S. PATENT DOCUMENTS

| | | | |
|---|---|---|---|
| 1,236,622 | 8/1917 | Taylor | 169/26 |
| 1,450,219 | 4/1923 | Newton | 169/38 |
| 2,917,116 | 12/1959 | Wyant | 169/57 |
| 3,040,815 | 6/1962 | Pambello | 169/26 X |
| 3,209,937 | 10/1965 | Hirst et al. | 169/26 X |
| 3,863,720 | 2/1975 | Young | 169/61 X |
| 3,907,037 | 9/1975 | Linsalato | 169/57 |
| 4,411,318 | 10/1983 | Zeischegg et al. | 169/26 |
| 4,609,047 | 9/1986 | Pieczykolan | 169/38 |
| 4,619,327 | 10/1986 | Pieczykolan | 169/38 |
| 4,905,765 | 3/1990 | Hein | 169/26 X |

FOREIGN PATENT DOCUMENTS

| | | | |
|---|---|---|---|
| 2171476 | 9/1973 | France . | |
| 1406677 | 9/1975 | United Kingdom | 169/61 |
| 2072011 | 9/1981 | United Kingdom | 169/54 |
| 1442226 | 12/1988 | U.S.S.R. | 169/58 |

*Primary Examiner*—David M. Mitchell
*Assistant Examiner*—Andrew C. Pike
*Attorney, Agent, or Firm*—Amster, Rothstein & Ebenstein

[57] ABSTRACT

A fail-safe phial-type fire extinguishing system is intended to be activated when the environment in which at least a first part of the system (namely, a detector or sensor) is situated reaches a first predetermined condition, and is activated as a fail-safe measure when the environment in which at least a second part of the system (namely, the phial) is situated reaches a second predetermined condition, the system including a fire extinguisher, a detector or sensor, and an extinguisher activator including a heater.

7 Claims, 3 Drawing Sheets

FAILSAFE PHIAL-TYPE FIRE EXTINGUISHING SYSTEM

This is a continuation of copending application Ser. No. 07/619,885 filed on Nov. 29, 1990, now abandoned.

The present invention relates to fire extinguishing systems, and in particular to fire extinguishing systems activated by heat sensitive bulbs. Systems of this type are well suited for incorporation in fire resistant letterboxes.

The continued loss of life and property through fire has led to a demand for compact fire extinguishing systems having a rapid response to the presence of fire. However, in all systems there is a significant time lag between the insertion of the burning material, and the subsequent quenching of the fire. In this period the contents of the letterbox can be damaged. The present invention seeks to reduce the response times of such devices.

In particular, there has been a worrying increase in the incidence of arson attacks on residential and commercial properties. Often incendiary devices are put through the letterbox of the premises. The present invention further seeks to neutralise the effects of such devices.

According to a first aspect of the invention there is provided a release device for fire extinguisher means comprising a sealed envelope containing a liquid, wherein the envelope breaks when the temperature of the liquid therein reaches a predetermined value, characterised in that the device further comprises associated heating means. According to a second aspect of the invention there is provided a fire extinguishing system comprising fire extinguisher means, extinguisher activation means comprising detection means which are responsive to changes in the environment in which the system is situated, wherein the extinguisher activation means activate the fire extinguisher when the temperature of at least part of the extinguisher activation means exceeds a predetermined temperature, characterised in that the extinguisher activation means further comprises heating means, wherein the detection means activate the heating means to raise the temperature of the extinguisher activation means above said predetermined temperature in response to predetermined changes in the environment.

In a preferred arrangement, the detection means is responsive to one or more of the following; smoke, hydrocarbon vapours, infrared radiation, or the rate of heat change in the environment.

Preferably, the extinguisher activation means comprises a phial of liquid sealing a fire inhibiting substance in the fire extinguisher means. The phial ruptures at said predetermined temperature.

Preferably, the system is mounted in a receptacle for use as a letterbox having first and second openings therein, wherein both of the openings are closable in a substantially gas tight way by flap means.

According to a third aspect of the invention there is provided a receptacle for use as a fire resistant letterbox, said receptacle having first and second openings therein and flap means, said flap means being adapted to close said first and second openings in a substantially gas tight way, wherein said receptacle contains fire extinguishing means and sensing means, and said fire extinguishing means are automatically ativated by said sensing means when a fire takes place within said receptacle.

In a preferred arrangement said sensing means comprises a phial of liquid, and said phial breaks when the temperature around it reaches a chosen value.

Preferably, said fire extinguishing means comprises a rechargeable cylinder, and said cylinder is filled with a fire inhibiting substance. The fire extinguishing means are placed so that said fire inhibiting substance discharges into the upper part of said receptacle.

Preferably, said fire extinguishing means prevent the insertion of a straight member through said receptacle, via said first and second openings.

In order that the invention and its various other features may be understood more easily, embodiments thereof will now be described, by way of example only, with reference to the drawings wherein.

Figure 1:
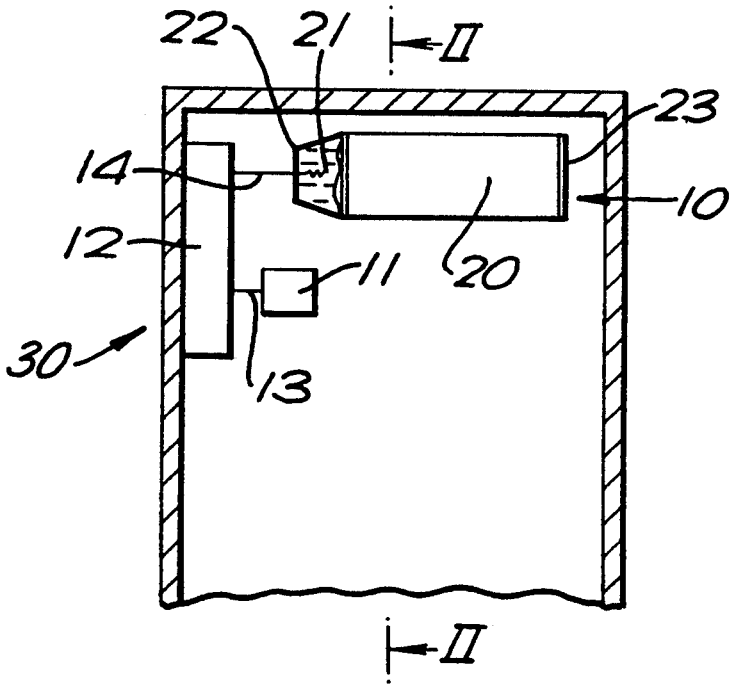
FIG. 1 is a schematic, vertical cross section of a letterbox incorporating a fire extinguishing system according to the first and second aspects of the invention.
Figure 2:
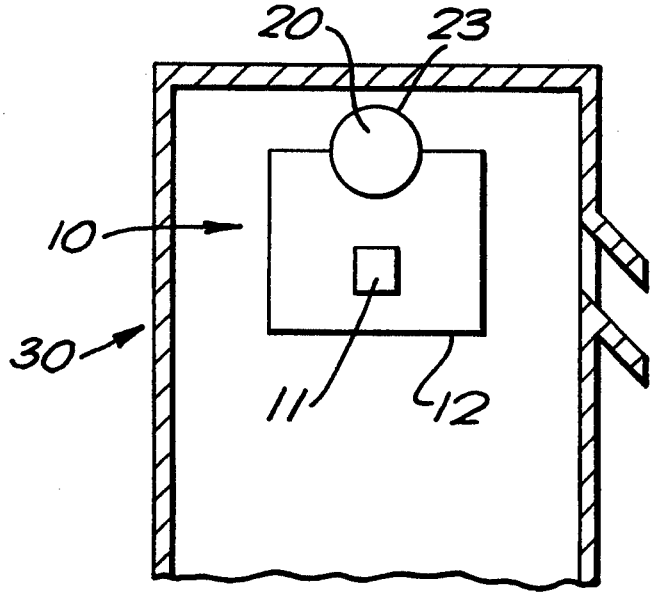
FIG. 2 is a section on II—II in FIG. 1.
Figure 3:
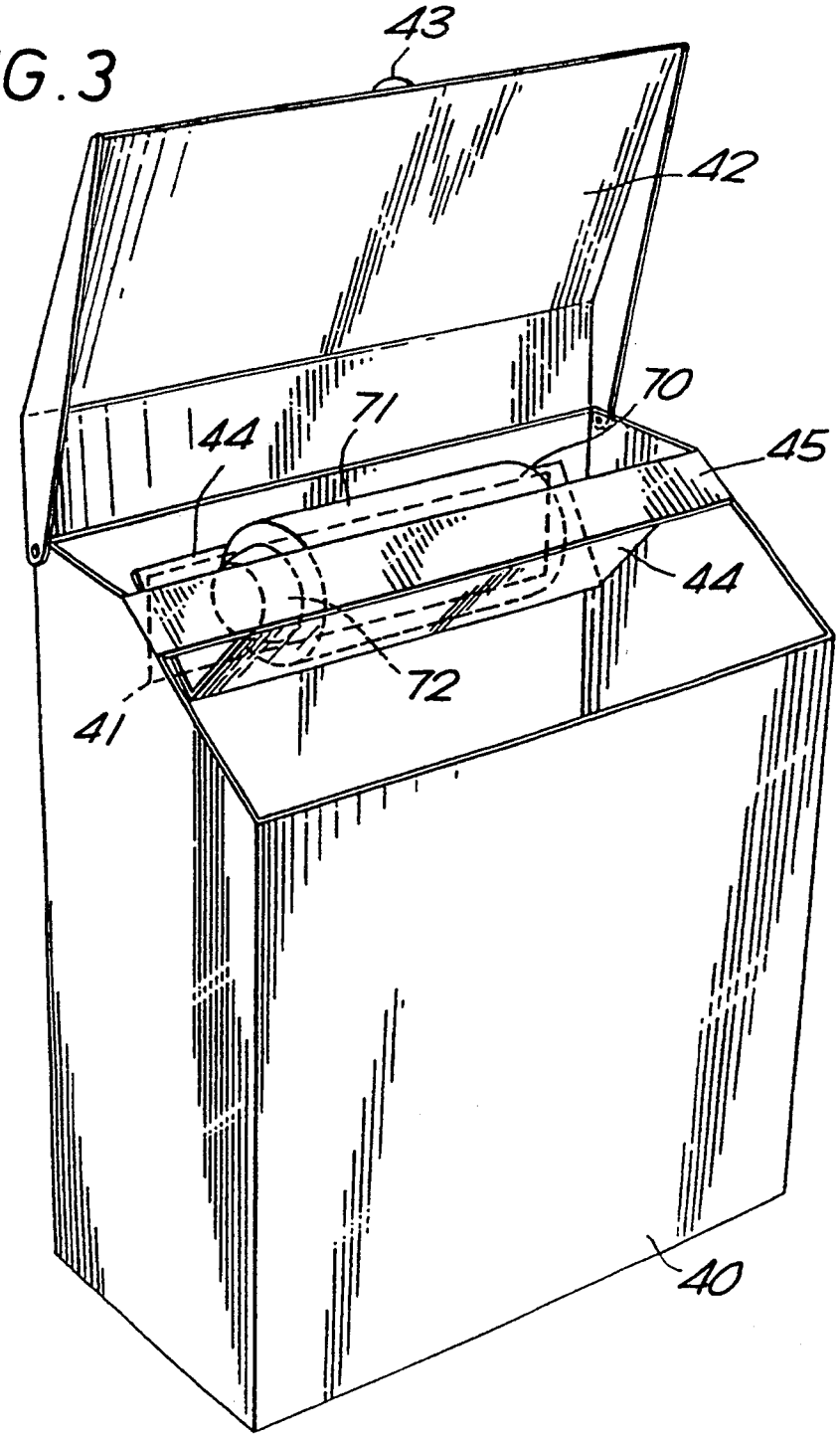
FIG. 3 is a perspective view of a letterbox according to the third aspect of the invention.
Figure 4:
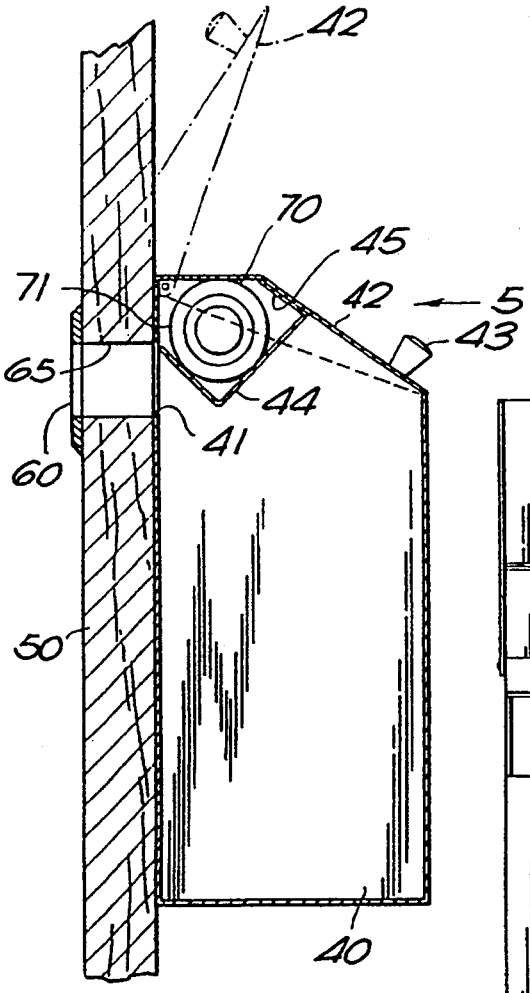
FIG. 4 is a sectional side view of the letterbox in FIG. 3 fixed to a door, having a letter plate and letter opening. The flap is shown in both the open and shut positions.
Figure 5:
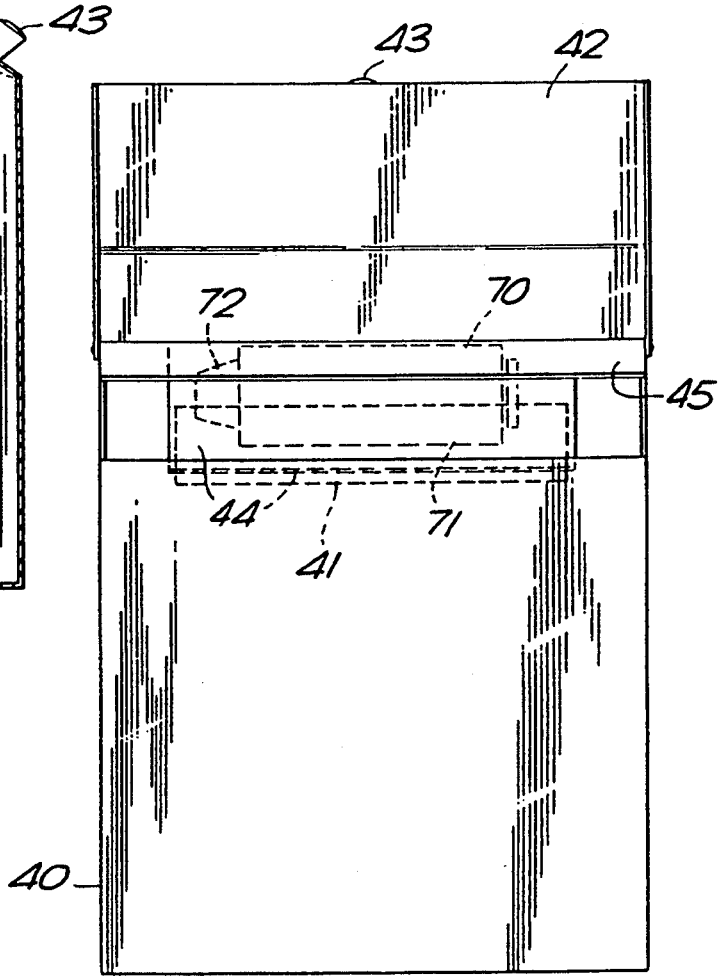
FIG. 5 is a view from direction 5 in FIG. 4, with the flap open.

The fire extinguishing system 10 comprises a detector 11, a control unit 12, and a fire extinguisher 20. A suitable application for the system is in a letterbox 30.

The detector 11 is responsive to one or more of the following: smoke, hydrocarbon vapours, infrared radiation or the rate of heat change in the letterbox. The detector is connected to the control unit 12 by a signal line 13. The control unit is connected to a heating element 21 by a signal line 14. The heating element is contained in a glass phial 22 filled with yellow alcohol. The phial comprises a part of the fire extinguisher 20. The fire extinguisher further comprises a cylinder 23 filled with a denser than combustion-inhibiting gas such as Halon. The cylinder is sealed by the phial 22.

The system is mounted in the upper part of the letterbox 30. The whole system is fitted inside the letterbox and is powered by either mains electricity or by a battery. When material inside the letterbox 30 starts to burn smoke is evolved, which is detected by the detector 11 if it is responsive to smoke. When the concentration of smoke reaches a pre-determined value the control unit 12 energises the heating element 21. This heats the alcohol in the phial 22 to a fixed temperature, preferably about 55° C., causing it to boil and thereby rupturing the phial and allowing the combustion inhibiting gas to escape from the cylinder 23. The gas floods the letterbox 30 and extinguishes the fire.

An indicator of the presence of combustion, or that combustion is imminent, is an increase in the intensity of infrared radiation that is incident on the detector 11. Burning material, or hot material just below its ignition temperature, will radiate relatively large amounts of infrared radiation. If the detector 11 is responsive to infrared radiation the fire extinguisher 20 can be activated when the intensity of the infrared radiation reaches a pre-determined value and the detector signals the control unit 12, thereby energising the heating element 21.

Another method of detecting the onset of combustion in the letterbox 30 is by measuring the rate of heat change using a suitably responsive detector 11. When combustion starts in the letterbox there is an increase in the rate of heat change therein. When the rate of heat change reaches a pre-determined value the detector 11 signals the control unit 12, thereby activating the fire extinguisher 20.

When a fire is deliberately started inside a letterbox, a hydrocarbon fuel is often used to initiate combustion. When the fuel is introduced into the receptacle the vapours that are evolved are detected by the detector 11. When the concentration of the vapours reaches a predetermined value the control unit 12 energises the heating element 21, thereby activating the fire extinguisher 20. The rapid response time of the system means that the letterbox 30 is filled with the combustion inhibiting gas before an arsonist can introduce an ignition source into the letterbox to ignite the hydrocarbon vapours therein.

Should the detector 11, control unit 12, or heating element 21 fail, burning material in the letterbox will heat up the air therein, which will circulate around the fire extinguisher 20. This will cause the alcohol in the phial 22 to heat up until the phial ruptures and the combustion inhibiting gas floods the letterbox 30.

After a fire or the introduction of hydrocarbon in the letterbox 30 the fire extinguisher 20 is removed. The cylinder 23 is refilled with combustion inhibiting gas, fitted with a new alcohol filled phial 22, and refitted in the letterbox.

An advantage of the system is that it normally fills the letterbox 30 with combustion inhibiting gas before material in the letterbox can start to burn on a significant scale. This is because the system is activated by conditions which indicate the start of combustion, or the potential for combustion to occur, respectively.

The electrical parts of the system are fail safe, since if the heating element is rendered inoperative, the extinguisher 20 will still be activated by direct heat from the fire heating the alcohol in the phial 22. The system can be used in any type of letterbox, including pillar boxes.

The heating element 21 can be positioned outside the phial 22, in any position where there is satisfactory thermal contact between the heating element and the alcohol contained in the phial.

The phial 22 can be filled with any substance that is chosen to boil at a pre-determined temperature. The cylinder 23 can be filled with any suitable combustion inhibiting substance.

The system can also be used in conventional sprinkler systems that are activated by a heat sensitive bulb. Conventional bulbs can be replaced by bulbs containing a heating element, which is energised by an additional detector detecting either smoke, hydrocarbon vapours, infrared radiation, or the rate of heat change. The sprinkler system may thus also be activated before a full-scale fire has become established.

A third aspect of the invention proposes a fire resistant letterbox. An embodiment of this aspect comprises a substantially oblong fireproof box 40 for mounting vertically on a door 50, having a letter plate 60 and letter opening 65 mounted horizontally in the central portion of the door of a house. On one side of the letterbox is an entrance slot 41, the shape of which corresponds to that of the letter opening in the door. The top of the letterbox forms a hinged flap 42. A knob 43 is provided to allow the flap to be raised to gain access to the inside of the letterbox. When both the flap and the letter plate are closed the letterbox is substantially gas and liquid tight.

Mounted in the top of the letterbox is a fire extinguisher 70. The extinguisher is supported in a "V" shaped holder 44 that is in turn supported by a strip member 45 that extends across the top of the box 40. The length of the "V" shaped holder is in excess of that of the extinguisher. The extinguisher comprises a cylinder 71 filled with a denser than air combustion inhibiting gas such as Halon. The cylinder is sealed by a glass phial 72 filled with yellow alcohol. The position of the extinguisher and its holder is configured so that there are no straight unobstructed paths through the letterbox and out of the flap from the entrance slot.

The design of the letterbox minimises the effects of arson attacks directed at a property through the letter plate. A common mode of attack is to drop lighted rags or similar combustible material into the letterbox. The letterbox will restrict the air supply to the burning material and if the material is not burning too strongly the fire will be put out. If the material is burning strongly the air within the letterbox will heat up,and circulate around the fire extinguisher in the top of the letterbox. The alcohol in the phial will heat up until at a fixed temperature, preferably about 55° C., the phial will burst and the combustion inhibiting gas will be released and will flood the letterbox, extinguishing the burning material. The fireproof material that the letterbox is made of protects the door and the interior of the house from the effects of the fire. Typically, the material has a relatively low thermal conductivity. The extinguisher is protected from the radiation of the flames by the shielding effect of the "V" shaped holder.

After an unsuccessful attack it is not uncommon for the perpetrator to return and make a further attack. After the burning material from the first attack has been extinguished the combustion inhibiting gas is retained inside the substantially gas tight letterbox. Any further burning material that is inserted into the letterbox during a further attack will be extinguished by this gas, thereby foiling the further attack.

Another mode of attack is to open the letter plate, use a stick or similar tool to open the flap 42 of the letterbox and then direct a burning jet of fuel or solvent from a domestic detergent bottle right through the letterbox and into the premises. The presence of the extinguisher 70 and the holder 45 make it impossible to open the flap 42 from the letter plate 65 using a crowbar or similar tool. This prevents burglars from operating door locks inside the door from the outside, through the letterbox, and gaining entry to the premises. If burning liquid is poured into the letterbox it will be safely contained and extinguished either due to lack of air or by the action of the extinguisher 70.

Apart from the stated advantages of fire resistance and additional security the letterbox also prevents pets damaging the incoming mail.

The fire extinguishing system disclosed is particularly suited for use in fire resistant letterboxes of the type described above.

I claim:

1. A fail-safe phial-type fire extinguisher system that is normally activated when the environment in which at least a first part of said system is situated reaches a first predetermined condition, and that is activated as a fail-safe measure when the environment in which at least a second part of said system is situated reaches a second predetermined condition, said system comprising fire extinguisher means, detection means and extinguisher activation means;

said fire extinguisher means including a sealed phial sealing a fire inhibiting substance in said fire extinguisher means, said phial containing a liquid and being formed to rupture and release said fire inhibiting substance from said fire extinguisher means when said liquid in said phial exceeds a predetermined temperature, said liquid in said phial being said second part of said system and the temperature of said liquid in said phial being above said predetermined temperature being said second predetermined condition, said extinguisher activation means including heating means, and said detection means activating said heating means to raise the temperature of said liquid in said phial above said predetermined temperature in response to predetermined changes in the environment about at least part of said detection means, said part of said detection means being said first part of said system and said predetermined changes in the environment about said part of said detection means being said first predetermined condition, said predetermined changes including an increase in the temperature in the environment about said part of said detection means to a given temperature less than said predetermined temperature.

2. The system according to claim 1 wherein said liquid in said phial differs from said fire inhibiting substance.

3. The system according to claim 1 wherein said first part of said system is said detection means, said second part of said system is said liquid in said phial in said fire extinguisher means, and said second predetermined condition is said predetermined temperature.

4. The system according to claim 1 wherein said detection means is disposed remote from said first extinguisher means.

5. A fail-safe phial-type fire extinguisher system that is normally activated when the environment in which at least a first part of said system is situated reaches a first predetermined condition, and that is activated as a fail-safe measure when the environment in which at least a second part of said system is situated reaches a second predetermined condition, said system comprising fire extinguisher means, detection means and extinguisher activation means;

said fire extinguisher means including a sealed phial sealing a fire inhibiting substance in said fire extinguisher means, said phial containing a liquid and being formed to rupture and release said fire inhibiting substance from said fire extinguisher means when said liquid in said phial exceeds a predetermined temperature, said liquid in said phial being said second part of said system and the temperature of said liquid in said phial being above said predetermined temperature being said second predetermined condition, said extinguisher activation means including heating means, and said detection means activating said heating means to raise the temperature of said liquid in said phial above said predetermined temperature in response to predetermined changes in the environment about at least part of said detection means, said part of said detection means being said first part of said system and said predetermined changes in the environment about said part of said detection means being said first predetermined condition, said predetermined changes including an indicator of an increase in the temperature in the environment about said part of said detection means to a given temperature less than said predetermined temperature.

6. The system according to claim 5 wherein said indicator is at least one of smoke, hydrocarbon vapour, infrared radiation, and the rate of heat change.

7. The system according to claim 6 wherein said indicator is smoke.

* * * * *